US010774781B2

(12) United States Patent
Azevedo et al.

(10) Patent No.: US 10,774,781 B2
(45) Date of Patent: Sep. 15, 2020

(54) PISTON WITH ANTI-COKING DESIGN FEATURES

(71) Applicant: FEDERAL-MOGUL CORPORATION, Southfield, MI (US)

(72) Inventors: Miguel Azevedo, Ann Arbor, MI (US); Warran Boyd Lineton, Chelsea, MI (US); Geoffrey Neil Ainsworth, Ann Arbor, MI (US)

(73) Assignee: Tenneco, Inc., Lake Forest, IL (US)

( * ) Notice: Subject to any disclaimer, the term of this patent is extended or adjusted under 35 U.S.C. 154(b) by 620 days.

(21) Appl. No.: 15/414,954

(22) Filed: Jan. 25, 2017

(65) Prior Publication Data

US 2018/0209375 A1 Jul. 26, 2018

(51) Int. Cl.
*F02F 3/22* (2006.01)
*F02F 3/00* (2006.01)

(52) U.S. Cl.
CPC ..... *F02F 3/22* (2013.01); *F02F 3/0015* (2013.01); *F02F 3/003* (2013.01)

(58) Field of Classification Search
CPC ..... F02F 3/22; F02F 3/18; F02F 3/225; F02F 3/045; F02F 3/16; F02F 3/0015; F02F 3/003
See application file for complete search history.

(56) References Cited

U.S. PATENT DOCUMENTS 1,678,957 A 7/1928 Philipp
1,795,348 A 3/1931 Schmidt
2,573,536 A 10/1951 Bodine, Jr.
2,760,475 A 8/1956 Bodine, Jr.
3,314,402 A 4/1967 Tillack
6,659,062 B1 * 12/2003 Issler ..... F02F 3/22 123/193.6
7,131,418 B2 11/2006 Wieland
7,281,466 B1 10/2007 Wilksch et al.
7,299,772 B1 11/2007 Hardin
8,739,747 B2 6/2014 Kim
9,228,480 B2 * 1/2016 Wirkkala, II ..... F01P 3/10
10,240,556 B2 * 3/2019 Ni ..... F02F 3/0015
2011/0185889 A1 * 8/2011 Muscas ..... F02F 3/003 92/158
2013/0025550 A1 1/2013 Ißler et al.
2014/0123930 A1 5/2014 Lineton et al.
2014/0238332 A1 8/2014 Laqua et al.

* cited by examiner

*Primary Examiner* — Abiy Teka
(74) *Attorney, Agent, or Firm* — Robert L. Stearns; Dickinson Wright, PLLC

(57) ABSTRACT

A steel piston with anti-coking design features is provided. The piston includes an upper crown portion and a lower crown portion forming an outer cooling gallery therebetween. The outer cooling gallery is substantially closed except for an oil inlet, oil outlet, and optional oil passage(s) to a central cooling gallery. According to one embodiment, at least one anti-coking insert is disposed in the outer cooling gallery and sized to prevent escaping through the oil inlet or the oil outlet. For example, the insert(s) can comprise a helical coil, a plurality of steel balls, coil springs, or chips formed of polymer with abrasive filler. Alternatively, an outer gallery floor to the outer cooling gallery includes a plurality of anti-coking openings disposed sequentially in decreasing spaced relation from one another, or anti-coking openings with varying lengths.

21 Claims, 5 Drawing Sheets

PISTON WITH ANTI-COKING DESIGN FEATURES

BACKGROUND OF THE INVENTION

1. Technical Field

This invention relates generally to pistons for internal combustion engines, and more particularly to pistons having cooling galleries.

2. Related Art

Pistons for internal combustion engines oftentimes have a single outer cooling gallery, a central cooling gallery, or two cooling galleries (dual galleries). The dual gallery pistons have an annular, radially outer cooling gallery which is substantially closed and an open central cooling gallery formed between upper and lower crown portions. During operation, cooling oil is contained in or sprayed into the cooling galleries to reduce the temperature of the surround metal body. However, oil deposits oftentimes accumulate on the inner walls bounding the cooling galleries, particularly the closed or substantially closed outer cooling gallery. As the oil deposits accumulate, the cooling effectiveness of the oil circulating therein diminishes.

These oil deposits, also referred to as oil coking, in the cooling galleries, is generally associated with high thermally loaded steel pistons. To reduce oil coking, coatings have been applied to the inner surfaces of the cooling galleries. However, the coating solutions and other known solutions to oil coking, are oftentimes expensive or not preferred for other reasons.

SUMMARY OF THE INVENTION

One aspect of the invention provides a piston with anti-coking design features that are oftentimes preferred over the coatings and other known solutions to oil coking. The piston comprises a piston body including an upper crown portion with an upper combustion wall and a lower crown portion. The upper crown portion and the lower crown portion form an outer cooling gallery therebetween. The lower crown portion presents an outer gallery floor of the outer cooling gallery. The outer gallery floor has an oil inlet allowing oil to flow into the outer cooling gallery and an oil outlet allowing oil to flow out of the outer oil gallery. At least one insert is disposed in the outer cooling gallery, and the at least one insert is sized to prevent escaping of the at least one insert through the oil inlet or through the oil outlet.

According to another embodiment, the outer gallery floor of the piston includes a plurality of anti-coking openings, the anti-coking openings are disposed sequentially in decreasing spaced relation from one another.

According to yet another embodiment, the outer gallery floor of the piston includes a plurality of anti-coking openings, each of the openings has a length extending circumferentially around the outer cooling gallery, and the lengths of the anti-coking openings vary from one another.

Another aspect of the invention provides a method of manufacturing a piston with anti-coking design features. The method comprises the step of providing a piston body including a lower crown portion and an upper crown portion with an upper combustion wall, the upper crown portion and the lower crown portion forming an outer cooling gallery therebetween, the lower crown portion presenting an outer gallery floor of the outer cooling gallery, the outer gallery floor having an oil inlet allowing oil to flow into the outer cooling gallery and an oil outlet allowing oil to flow out of the outer oil gallery. The method also includes disposing at least one insert in the outer cooling gallery, and the at least one insert is sized to prevent the at least one insert from escaping through the oil inlet or the oil outlet.

According to another embodiment, the method includes providing a piston body including a lower crown portion and an upper crown portion with an upper combustion wall, the upper crown portion and the lower crown portion forming an outer cooling gallery therebetween, the lower crown portion presenting an outer gallery floor of the outer cooling gallery, the outer gallery floor including a plurality of anti-coking openings, and the anti-coking openings being disposed sequentially in decreasing spaced relation from one another.

According to yet another embodiment, the method includes providing a piston body including a lower crown portion and an upper crown portion with an upper combustion wall, the upper crown portion and the lower crown portion forming an outer cooling gallery therebetween, the lower crown portion presenting an outer gallery floor of the outer cooling gallery, the outer gallery floor presenting a plurality of anti-coking openings extending therethrough, each of the openings having a length extending circumferentially around the outer cooling gallery, and the lengths of the anti-coking openings varying from one another.

BRIEF DESCRIPTION OF THE DRAWINGS

These and other aspects, features and advantages of the invention will become more readily appreciated when considered in connection with the following detailed description, appended claims and accompanying drawings, in which:

DETAILED DESCRIPTION OF EXEMPLARY EMBODIMENTS

Figure 1:
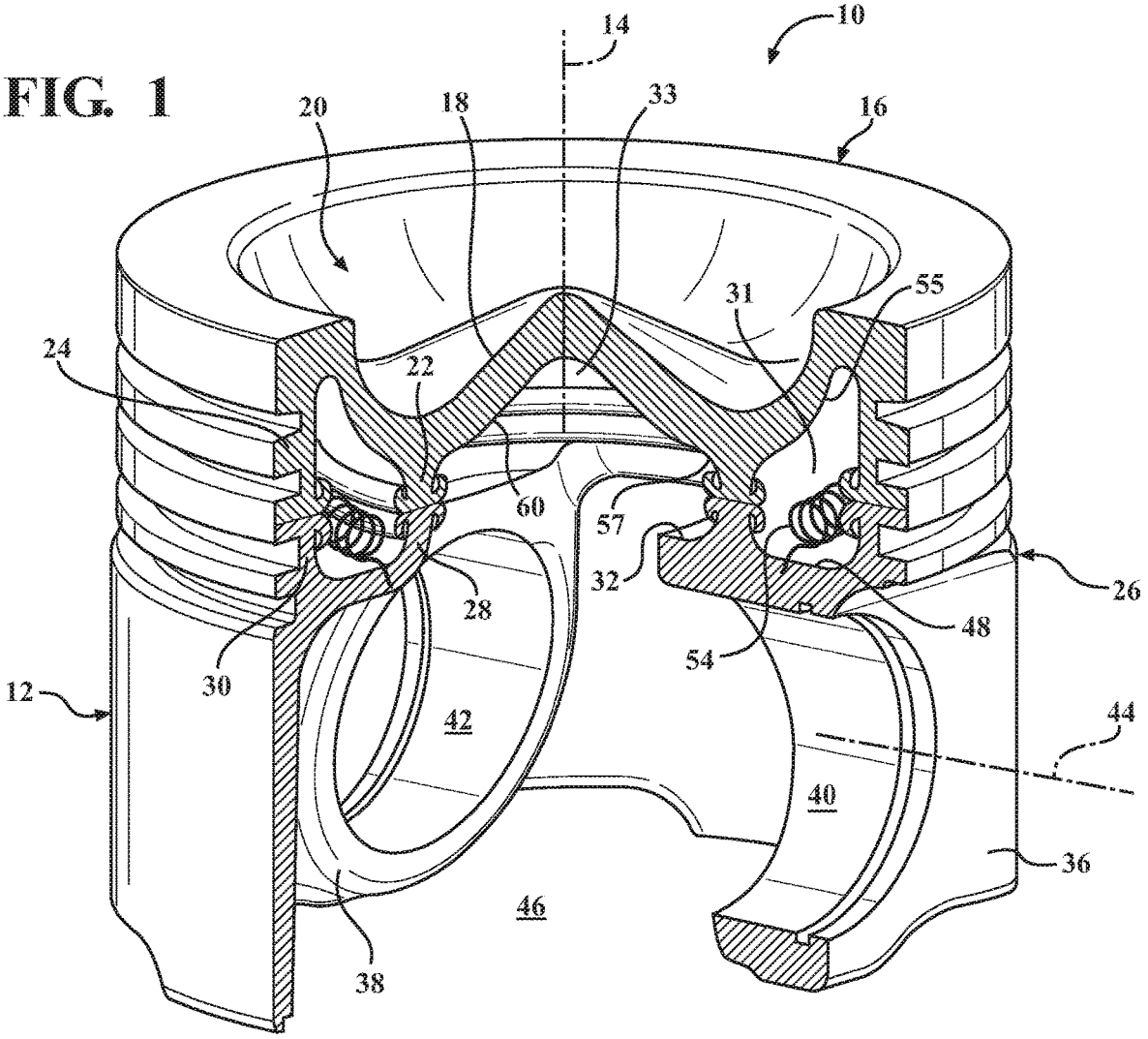
FIG. 1 is a cross-sectional perspective view of a piston with an outer cooling gallery comprising a helical coil for anti-coking according to one embodiment of the invention.
Figure 6:
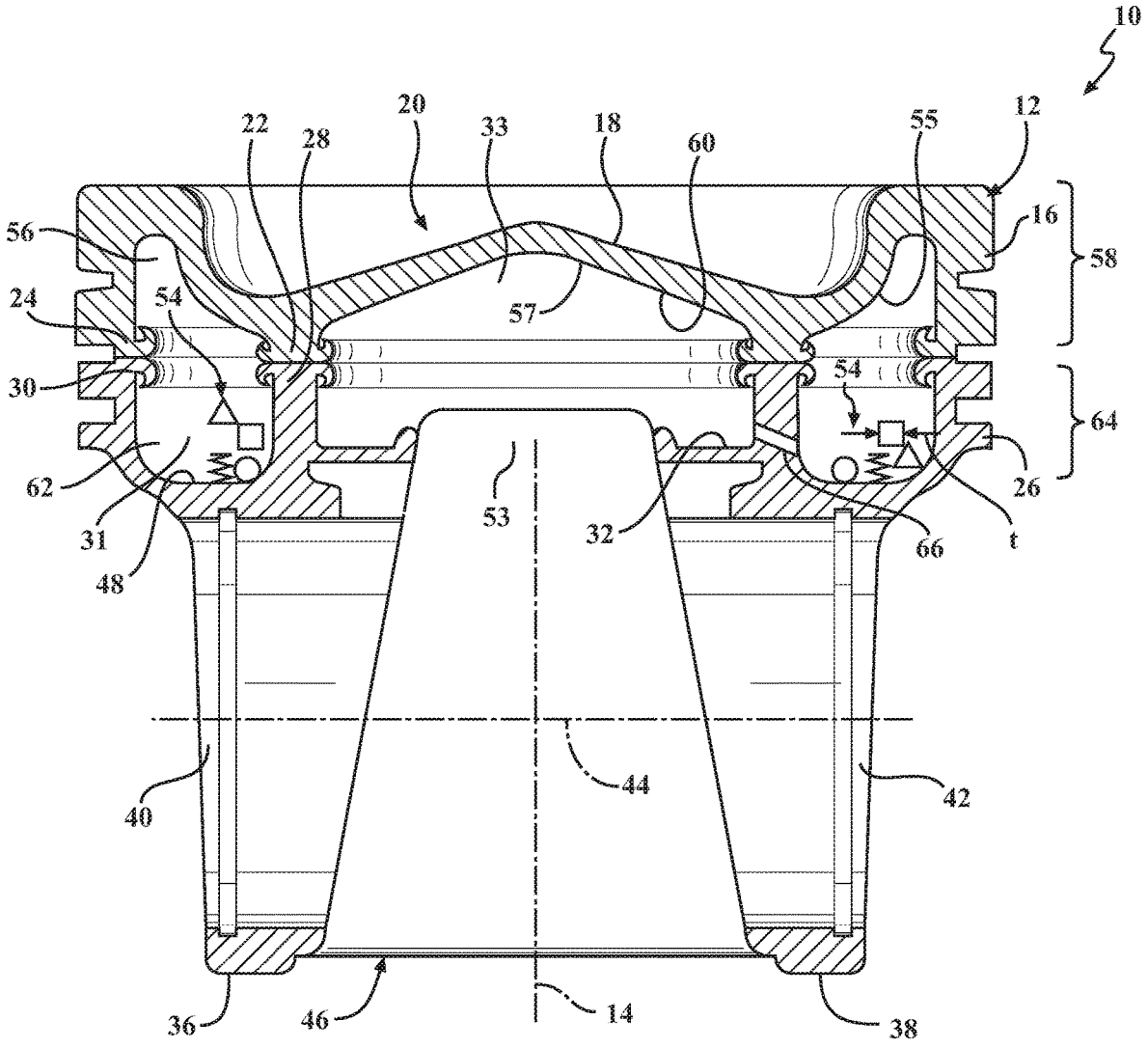
FIG. 6 is a cross-sectional view of a piston with an outer cooling gallery containing examples of anti-coking inserts according to another embodiment of the invention.
Figure 7:
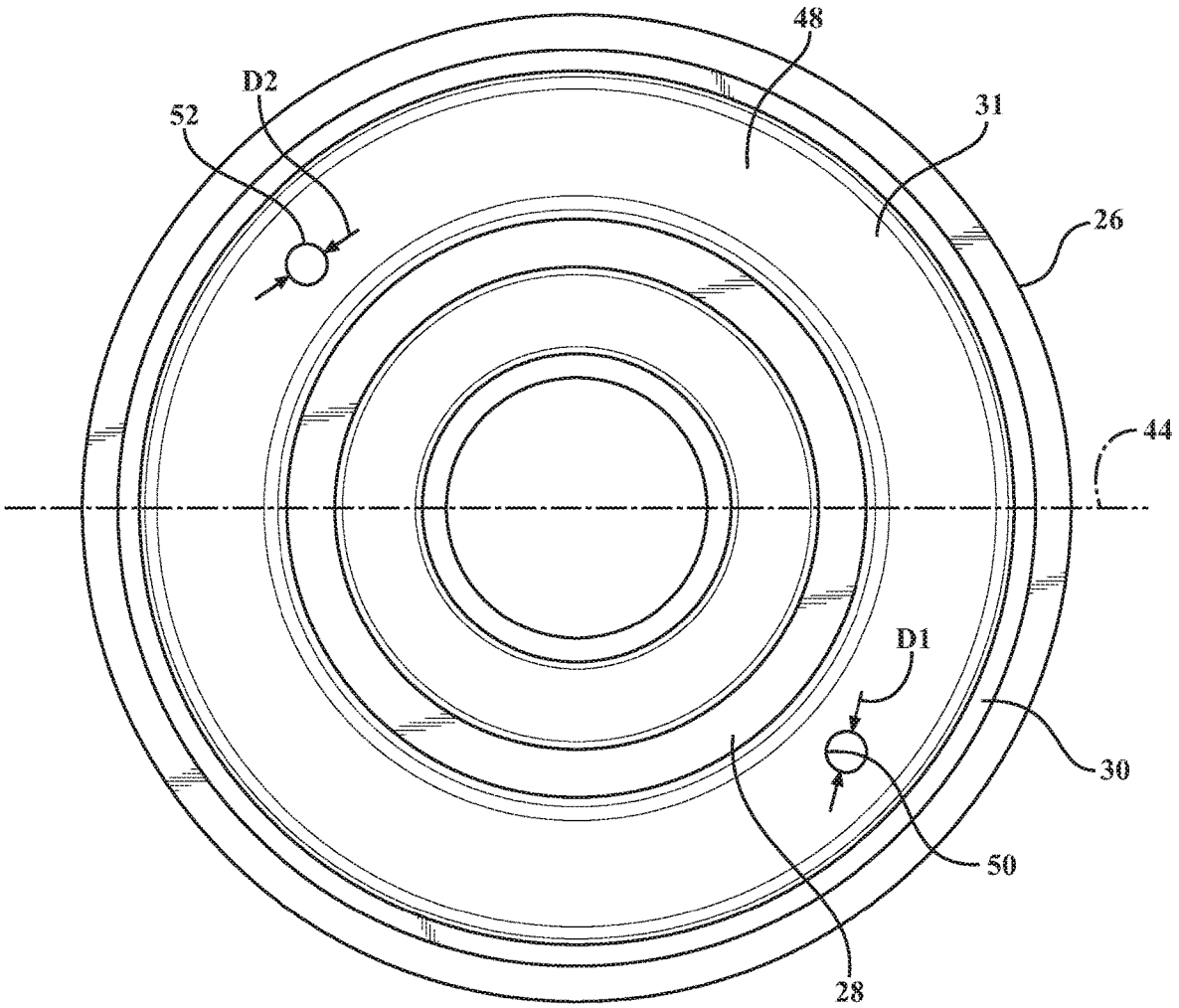
FIG. 7 is a plan view of the outer cooling gallery of FIG. 6 without the anti-coking inserts and showing an oil inlet and oil outlet to the outer cooling gallery.

One aspect of the invention provides a piston 10 designed with anti-coking features to reduce oil deposits caused by cooling oil during operating of the piston 10 and thus improve piston cooling. As shown in FIGS. 1 and 6, the piston 10 has a piston body 12 extending along a central axis 14 along which the piston body reciprocates within a cylinder bore (not shown). The piston body 12 is formed of metal, and preferably steel. The piston body 12 includes an upper crown portion 16 having dome or an upper combustion wall 18, represented here, by way of example and without limitation, as having a recessed combustion bowl 20, against which combustion forces directly act in the cylinder bore. The upper crown portion 16 has at least one, and shown here, by way of example and without limitation, as having a pair of annular upper ribs, referred to hereafter as an upper inner rib 22 and upper outer rib 24, depending from the upper combustion wall 18 to respective free ends. The piston body 12 further includes a lower crown portion 26 having at least one, and shown here, by way of example and without limitation, as having a pair of annular lower ribs, referred to hereafter as a lower inner rib 28 and lower outer rib 30, extending to respective free ends arranged in alignment for fixed abutment with the respective free ends of the upper inner and outer ribs 22, 24 to form and separate an outer cooling gallery 31 from a central region of the piston 10. The outer cooling gallery 31 presents an oil passage 72 extending circumferentially around the upper crown portion 18. The outer cooling gallery 31 also surrounds a central cooling gallery 33 located in the central region of the piston 10.

The lower crown portion 26, by way of example and without limitation, is shown as having an inner gallery floor 32 extending radially inwardly from the lower inner rib 28 toward the central axis 14. Further, the lower crown portion 26 has an outer gallery floor 48 extending laterally between the lower inner and outer ribs 28, 30. The lower inner rib 28, the lower outer rib 30, the upper inner rib 22, the upper outer rib 24, the upper combustion wall 18, and the outer gallery floor 48 present an inner surface 55 defining the outer cooling gallery 31. The lower inner rib 28, the upper inner rib 22, the upper combustion wall 18, and the inner gallery floor 32 also present an inner surface 57 defining the central cooling gallery 33 therebetween. The inner gallery floor 32 includes a central opening 53 to the central cooling gallery 33 along the central axis 14. According to another embodiment, the inner gallery floor 32 is not included and thus the central cooling gallery 33 is open.

According to certain embodiments, the outer gallery floor 48 has a through opening providing an oil inlet 50 to allow oil to flow into the outer gallery 31 and a through opening providing an oil outlet 52 to allow oil to flow outwardly from the outer gallery 31. As such, oil from the crankcase is able to flow upwardly into the outer cooling gallery 31 through the oil inlet 50, whereupon the oil is circulated about the outer cooling gallery 31 and then exits through the oil outlet 52. To further yet facilitate cooling the piston 10, the respective inlet and outlet oil flow openings 50, 52 extend through the outer gallery floor 48 of the outer cooling gallery 31 in diametrically opposed relation to one another. The openings 50, 52 are formed generally 45 degrees offset from the pin axis 44.

According to the example embodiments shown in FIGS. 1 and 6, the outer cooling gallery 31 of the upper crown portion 16 has an annular outer oil gallery pocket 56 extending from the inner and outer rib free ends upwardly into an upper ring belt region 58 and an annular inner oil gallery cavity or pocket 60 forming part of the central crown region extending upwardly from the inner free end beneath the combustion bowl 20. However, the outer cooling gallery 31 could comprise various other shapes. According to these embodiments, the lower crown portion 26 is formed, such as in a casting or forging process from steel or other metal, having an annular outer oil gallery pocket 62 extending from the inner and outer rib free ends downwardly into a lower ring belt region 64. To further facilitate cooling the piston 10, one or more oil flow passages can be provided in one or more of the inner ribs 22, 28 to allow cooling oil to flow from the outer cooling gallery 31 to the central cooling gallery 33. For example, as shown in FIG. 6, an intermediate oil passage 66 extends through the lower inner rib 28 in ascending relation from a lower most portion of the outer oil gallery 31 to a lower portion of the inner cooling gallery 33. As such, oil from the crankcase is able to flow upwardly into the outer cooling gallery 31 through the inlet opening 50, whereupon the oil is circulated about the outer cooling gallery 31 and channeled in part inwardly through the oil flow passage 66 into the central oil gallery 33. Upon joining or attaching the upper crown portion 16 to the lower crown portion 26, the central cooling gallery 33 is formed, and the annular outer oil gallery 31 is formed. The outer oil gallery 31 is substantially closed or sealed upon joining the upper crown portion 16 to the lower crown portion 26, except for the oil inlet 50, oil outlet 52, intermediate oil passage 66, and any other passage or small opening for conveying of cooling oil.

A pair of pin bosses 36, 38 depend generally from the outer and inner gallery floors 32, 48 to provide a pair of wrist pin bores 40, 42 aligned along the pin axis 44 for receipt of a wrist pin (not shown) with a space 46 provided between the pin bosses 38, 40 for receipt of a small end of a connecting rod (not shown).

The piston 10 is designed with at least one anti-coking feature to reduce oil deposits caused by cooling oil contained in the outer cooling gallery 31 during operation of the piston 10 and thus improve cooling of the piston 10. For example, one aspect of the invention is directed to creating mechanisms inside the outer oil gallery 31 that motivates the oil to move directionally avoiding stagnation and coking, for example by partial drainage and coil approach. Coking in cooling galleries is a problem oftentimes found with highly thermally loaded steel pistons. Coking is a four-variable function, and the variables include cooling media activation energy level (EA), absolute surface temperature (T) of the metal of the piston body 12, flux of cooling media (M), and residence time (RT) of the cooling media within the reactor, in this case the cooling oil in the outer cooling gallery 31. The coking process inception is amenable to calculation. An inspection of the Arrhenius equation and extrapolating to real life conditions inside of the engine shows that there are few options for adjusting the activation energy level (EA) and absolute surface temperature (T) of the metal of the piston body 12. The flux of the cooling media, i.e. lubricant oil, is limited by the expenditure of parasitic power to increase flow and the need to allow sufficient residual volume in the outer cooling gallery 31, such as to promote an effective cocktail shaker effect. The sufficient residual volume is generally in the range of 50% to 75% of the total volume of the outer cooling gallery 31. Therefore, the residence time (RT) of the cooling oil within the outer cooling gallery 31 is the remaining variable which can be adjusted to reduce coking.

According to one embodiment, at least one anti-coking insert 54 is disposed in the outer cooling gallery 31 to reduce the residence time of the cooling oil in the outer cooling gallery 31 and thus reduce coking. The insert(s) 54 is designed to clean the inner surface 55 of the outer cooling gallery 31 continuously during service and while the engine is running, thus preventing accumulation of oil deposits which could affect the cooling function of the outer cooling gallery 31. The at least one insert 54, also referred to as a flux capacitor, can comprise a variety of different sizes and shapes. However, each insert 54 is sized to prevent the insert 54 from escaping through the oil inlet 50, through the oil outlet 52, or through any other passage or opening for conveying cooling oil. For example, a minimum thickness t of each insert 54 is greater than a maximum diameter or dimension D1 of the oil inlet 50, greater than a maximum diameter or dimension D2 of the oil outlet 52, and greater than a maximum diameter or dimension of any other passage or opening to the outer cooling gallery 31 for conveying oil. The insert(s) 54 should also be shaped in a way that allows it to impact the upper combustion wall 18 of the outer cooling gallery 31 where oil deposits are likely. The insert(s) 54 should also be designed to not cause unacceptable noise, vibration, or harshness issues. The insert(s) 54 should also not impede oil flow significantly, and the insert(s) 54 should be durable to provide effective cleaning for the expected service life of the piston 10.

Figure 2:
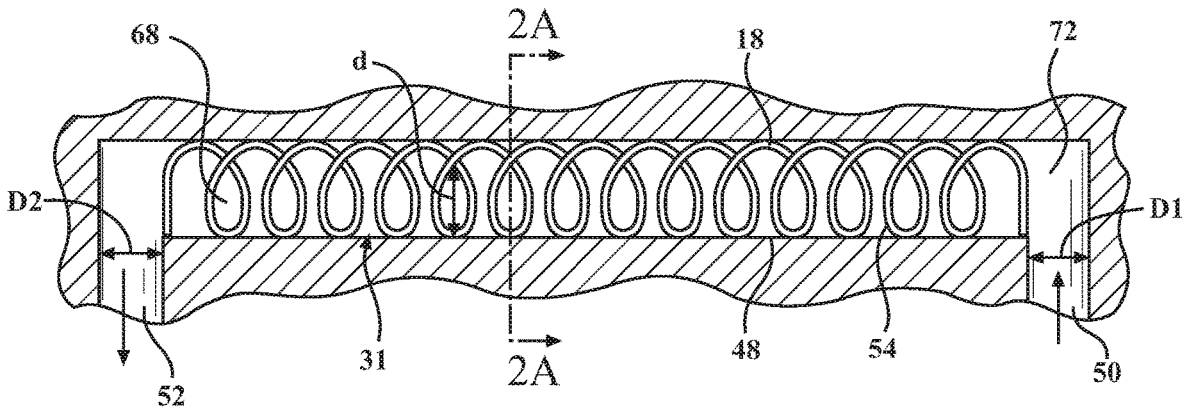
FIG. 2 is an unwrapped view of the outer cooling gallery comprising the helical coil of FIG. 1.
Figure 2A:
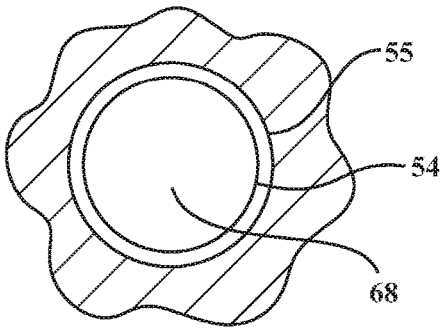
FIG. 2A illustrates the outer cooling gallery and helical coil of FIG. 2 along line A-A.

According to one example embodiment, as shown in FIGS. 1, 2, and 2A, one insert 54 is disposed in the outer cooling gallery 31, and the insert 54 is a helical coil. The helical coil presents a center coil opening 68 extending circumferentially around the outer cooling gallery 31. The center coil opening 68 is aligned with the oil passage 72 of the outer cooling gallery 31 for allowing oil to flow therethrough. The helical coil could be provided by forming the inner surface 55 of the outer cooling gallery 31 into the shape of the coil, such that the helical coil is part of the piston body 12. Alternatively, the helical coil could be a component disposed within the oil passage 72 separate from the piston body 12. Due to the shape of the helical coil and the ingress of the oil pressure wave during use of the piston 10, an inherent stabilized unidirectional flow towards the oil outlet 52 is established. An inner diameter d of the helical coil impedes to a degree any backflow, as the cooling fluid is either predominantly near the upper combustion wall 18 of the outer cooling gallery 31 or near the outer gallery floor 48 of the outer cooling gallery 31. Thus, the helical coil minimizes the residence time (RT) of the cooling oil in the outer cooling gallery 31 and thus reduces oil coking.

Figure 3:
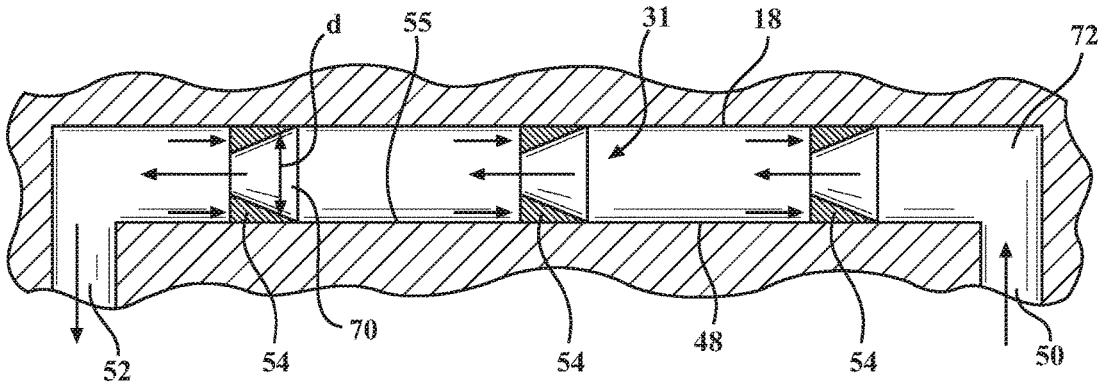
FIG. 3 is an unwrapped view of an outer cooling gallery containing scallops for anti-coking according to another embodiment of the invention.

According to another example embodiment, as shown in FIG. 3, the at least one insert 54 includes plurality of scallops spaced from one another circumferentially around the outer cooling gallery 31. Each scallop has an inner diameter d presenting a scallop center opening 70 aligned with the oil passage 72 of the outer cooling gallery 31 for allowing oil to flow therethrough. The inner diameter d of each scallop decreases in a direction moving from the oil inlet 50 to the oil outlet 52. For example, the scallops can be venturi-shaped. The scallops are typically fixed to the inner surface 55 of the outer cooling gallery 31, as shown in FIG. 3. Due to the shape of the scallops and the ingress of the oil pressure wave during use of the piston 10, an inherent directional flow towards the oil outlet 52 is established. The scallops impede to a degree any backflow, as the cooling oil is either predominantly near the upper combustion wall 18 of the outer cooling gallery 31 or near the outer gallery floor 48 of the outer cooling gallery 31. The scallops speed up the flow of oil along the length of the outer cooling gallery 31, minimize the residence time (RT) of the cooling oil in the outer cooling gallery 31, and thus reduce oil coking. Although the anti-coking inserts 54 of FIG. 3 are shown as symmetrical along the length of the outer cooling gallery 31, the anti-coking inserts 54 could be staggered along the length of the outer cooling gallery 31 without compromising their function.

According to yet another embodiment, the at least one insert 54 is free to move within the outer cooling gallery 31 during reciprocation of the piston body 12 in use. In this case, the outer cooling gallery 31 typically contains a plurality of the inserts 54. As the inserts 54 move throughout the cooling gallery 31 during reciprocation, they impact the inner surface 55 bounding the outer cooling gallery 31, thereby preventing or inhibiting the accumulation and build-up of oil deposits on the inner surface 55. As such, optimal cooling results in the outer cooling gallery 31 without "coking" the oil on the inner surface 55.

The inserts 54 can have various different designs, and example designs are shown in FIG. 6. The shape of the at least one insert 54 can be round, polygonal, square, triangular, prismatic, and/or toroidal. For example, the inserts 54 can include balls formed of steel, balls of coarse steel turnings, coil springs, or chips formed of high temperature resistant polymer with abrasive filler. According to one embodiment, the abrasive filler includes at least one of metal fibers and glass fibers. According to another embodiment, the at least one insert 54 includes at least one prismatic rod or prismatic wire having one axis significantly longer than two other axes.

According to another example embodiment, the at least one anti-coking feature includes a plurality of anti-coking openings 70 in the outer gallery floor 48. In this case, the oil inlet 50 and the oil outlet 52 are not required. The anti-coking openings 70 can be the same size or difference sizes. For example, each anti-coking opening 70 can have a circular or oblong shape. The anti-coking openings 70 can be used alone or with the at least one anti-coking insert 54.

Figure 4:
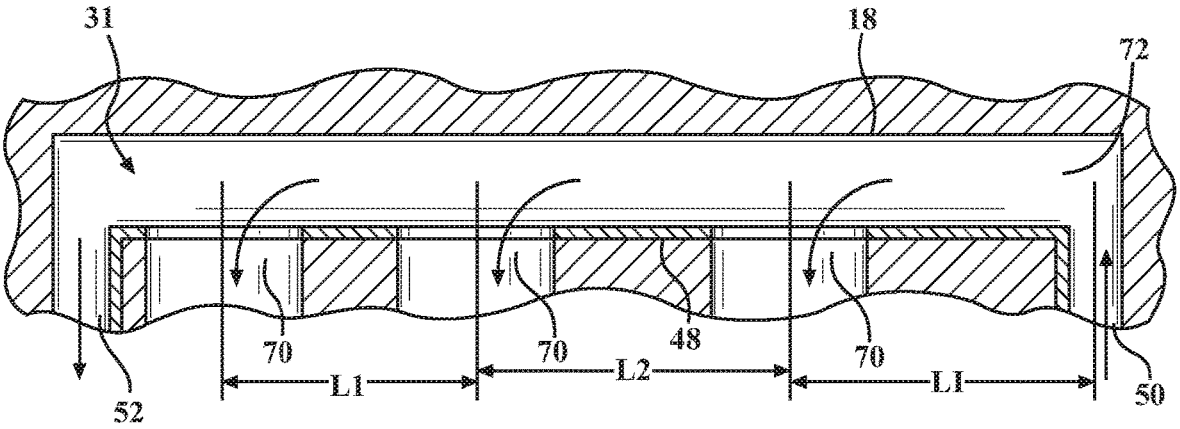
FIG. 4 is an unwrapped view of an outer cooling gallery with anti-coking openings to the outer cooling gallery according to another embodiment of the invention.

In the example embodiment of FIG. 4, the anti-coking openings 70 are disposed sequentially in decreasing spaced relation from one another. Preferably, the anti-coking openings 70 are spaced in a way which sequentially minimizes the residence time (RT) of the cooling oil in the outer cooling gallery 31 until it finds the next anti-coking opening 70. Thus, due to drainage of the superheated cooling oil, the oil coking which would otherwise occur is avoided. FIG. 4 shows the lengths L1, L2, LI between the anti-coking openings 70, wherein L1<L2<LI.

Figure 5:
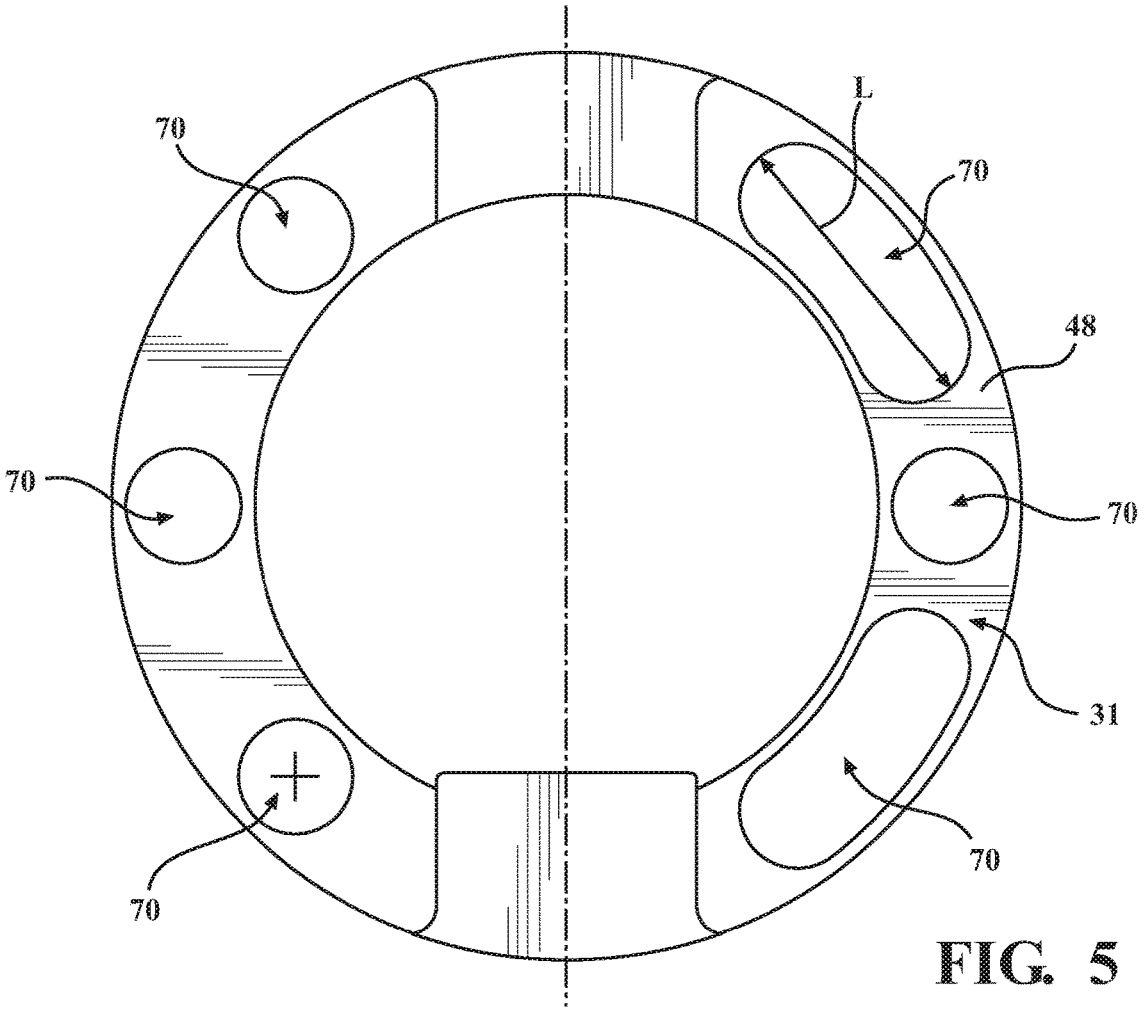
FIG. 5 is a plan view of an outer cooling gallery with anti-coking openings according to yet another embodiment of the invention.

In the example embodiment of FIG. 5, each anti-coking opening 70 has a length L extending circumferentially around the outer cooling gallery 31, and the lengths L of the anti-coking openings 70 vary from one another. For example, the anti-coking openings 70 can be drilled to the desired size, or drilled to form oblong slits as shown in FIG. 5.

Another aspect of the invention provides a method of manufacturing the piston 10 with the at least one anti-coking feature. The piston body 12 can be formed by forging or casting one piece or multiple pieces of metal. According to one embodiment, the method includes providing the piston body 12 including the lower crown portion 26 and the upper crown portion 16 with an upper combustion wall 18. The upper crown portion 16 and the lower crown portion 26 form the outer cooling gallery 31 therebetween. The lower crown portion 26 presents an outer gallery floor 48 of the outer cooling gallery 31, and the outer gallery floor 48 has an oil inlet 50 allowing oil to flow into the outer cooling gallery 31 and an oil outlet 52 allowing oil to flow out of the outer oil gallery 31. The step of providing the piston body 12 typically includes joining the upper crown portion 16 to the lower crown portion 26, for example by welding.

The method according to this embodiment also includes disposing the at least one insert 54 in the outer cooling gallery 31, wherein the at least one insert 54 is sized to prevent the at least one insert 54 from escaping through the oil inlet 50 or the oil outlet 52. The insert(s) 54 is typically disposed in the outer cooling gallery 31 before joining, for by example welding, the upper crown portion 16 to the lower crown portion 26. After joining, the at least one insert 54 is contained with the resulting outer cooling gallery 31. The at least one insert 54 can be disposed within one of the pockets 56, 62, as shown in FIG. 6. Alternatively, the step of providing the piston body 12 includes joining the upper crown portion 16 to the lower crown portion 26, and the step of disposing the at least one insert 54 in the outer cooling gallery 31 is conducted after the joining step. In this case, the method can include compressing the least one insert 54, such as a coil spring, through the oil inlet 50 and/or the oil outlet 52, and then allowing the at least one insert 54 to expand inside the outer cooling gallery 31 to prevent escaping of the insert 54 back through the openings 50, 52 during use. The insert(s) 54 which are in the form of a prismatic 'rod' or 'wire' with one axis significantly longer than the other two axes could also be inserted into the outer cooling gallery 31 through the oil inlet 50 or oil outlet 52 after joining the upper crown portion 16 to the lower crown portion 26.

According to another example embodiment, the method of manufacturing the piston 10 includes providing the piston body 12 with the lower crown portion 26 and the upper crown portion 16 with the upper combustion wall 18, wherein the upper crown portion 16 and the lower crown portion 26 form the outer cooling gallery 31 therebetween, the lower crown portion 26 presents the outer gallery floor 48 of the outer cooling gallery 31, the outer gallery floor 48 includes a plurality of the anti-coking openings 70, and the anti-coking openings 70 are disposed sequentially in decreasing spaced relation from one another.

According to yet another example embodiment, the method of manufacturing the piston 10 includes providing the piston body 12 including the lower crown portion 26 and the upper crown portion 16 with the upper combustion wall 18, wherein the upper crown portion 16 and the lower crown portion 26 form the outer cooling gallery 31 therebetween, the lower crown portion 26 presents an outer gallery floor 48 of the outer cooling gallery 31, the outer gallery floor 48 presents a plurality of the anti-coking openings 70 extending therethrough, each of the openings has a length L extending circumferentially around the outer cooling gallery 31, and the lengths L of the anti-coking openings 70 vary from one another.

Obviously, many modifications and variations of the present invention are possible in light of the above teachings. For example, it is contemplated that the piston could be constructed as a monolithic piece of material, such as by being formed in a single steel cast process. Further, it is contemplated that the piston, rather than having a "dual gallery" construction, could have a single "outer oil gallery" with a substantially open central crown region. It is, therefore, to be understood that within the scope of the appended claims, the invention may be practiced otherwise than as specifically described.

What is claimed is:

1. A piston, comprising:

a piston body including an upper crown portion with an upper combustion wall, said piston body including a lower crown portion, said upper crown portion and said lower crown portion forming an outer cooling gallery therebetween, said lower crown portion presenting an outer gallery floor of said outer cooling gallery, said outer gallery floor having an oil inlet allowing oil to flow into said outer cooling gallery and an oil outlet allowing oil to flow out of said outer cooling gallery, said outer cooling gallery presenting an oil passage extending circumferentially around said upper crown portion, at least one insert disposed in said outer cooling gallery, said at least one insert being sized to prevent escaping of said at least one insert through said oil inlet or through said oil outlet, said at least one insert including a helical coil, and said helical coil presenting a center coil opening extending circumferentially around said outer cooling gallery and aligned with said oil passage for allowing oil to flow therethrough.

2. The piston of claim 1, wherein said at least one insert is free to move within said outer cooling gallery during reciprocation of said piston body in use.

3. The piston of claim 1, wherein said at least one insert includes a plurality of inserts.

4. The piston of claim 1, wherein a minimum thickness of each insert is greater than a maximum diameter or dimension of said oil inlet, greater than a maximum diameter or dimension of said oil outlet, and greater than a maximum diameter or dimension of any other passage or opening to said outer cooling gallery.

5. The piston of claim 1, wherein said piston body is formed of steel and extends along a central axis, said upper combustion wall presents a recessed combustion bowl, said upper crown portion includes an upper inner rib and upper outer rib each extending circumferentially around said central axis and depending from said upper combustion wall to respective free ends, said lower crown portion includes a lower inner rib and lower outer rib each extending circumferentially around said central axis and to respective free ends fixed to said free ends of said upper inner and outer ribs, said lower crown portion includes said outer gallery floor extending laterally between said lower inner rib and said lower outer rib, said lower inner rib, said lower outer rib, said upper inner rib, said upper outer rib, said upper combustion wall, and said outer gallery floor present an inner surface defining said outer cooling gallery, said lower crown portion includes an inner gallery floor extending radially inwardly from said lower inner rib toward said central axis, said lower inner rib, said upper inner rib, said upper combustion wall, and said inner gallery floor present an inner surface defining a central cooling gallery therebetween, said inner gallery floor presents a central opening to said central cooling gallery along said central axis, said upper ribs are welded to said lower ribs, said piston body includes a pair of pin bosses depending from said gallery floors and presenting a pair of wrist pin bores aligned along a pin axis and spaced from one another, said oil inlet and said oil outlet are disposed diametrically opposite one another and about 45 degrees offset from said pin axis, at least one intermediate oil passage extends through said lower inner rib and ascends from said outer cooling gallery to said central cooling gallery, a minimum thickness of each insert is greater than a maximum diameter or dimension of said oil inlet, greater than a maximum diameter or dimension of said oil outlet, greater than a maximum diameter or dimension of each intermediate oil passage, and greater than a maximum diameter or dimension of any other opening to said outer cooling gallery.

6. A piston, comprising:

a piston body including an upper crown portion with an upper combustion wall, said piston body including a lower crown portion, said upper crown portion and said lower crown portion forming an outer cooling gallery therebetween, wherein said outer cooling gallery presents an oil passage extending circumferentially around said upper crown portion, said lower crown portion presenting an outer gallery floor of said outer cooling gallery, said outer gallery floor having an oil inlet allowing oil to flow into said outer cooling gallery and an oil outlet allowing oil to flow out of said outer cooling gallery, at least one insert disposed in said outer cooling gallery, said at least one insert being sized to prevent escaping of said at least one insert through said oil inlet or through said oil outlet, said at least one insert includes a plurality of scallops spaced from one another circumferentially around said outer cooling gallery, each of said scallops has an inner diameter presenting a scallop center opening aligned with said oil passage for allowing oil to flow therethrough, and said inner diameter decreases in a direction moving from said oil inlet to said oil outlet.

7. The piston of claim 6, wherein said scallops are venturi-shaped.

8. A piston, comprising:

a piston body including an upper crown portion with an upper combustion wall, said piston body including a lower crown portion, said upper crown portion and said lower crown portion forming an outer cooling gallery therebetween, said lower crown portion presenting an outer gallery floor of said outer cooling gallery, said outer gallery floor including a plurality of anti-coking openings, and said anti-coking openings being disposed sequentially in decreasing spaced relation from one another.

9. The piston of claim 8, wherein each of said anti-coking openings has a perimeter, and said outer gallery floor extends continuously around the entire perimeter of each of said anti-coking openings.

10. A piston, comprising:

a piston body including an upper crown portion with an upper combustion wall, said piston body including a lower crown portion, said upper crown portion and said lower crown portion forming an outer cooling gallery therebetween, said lower crown portion presenting an outer gallery floor of said outer cooling gallery, said outer gallery floor presenting a plurality of anti-coking openings, each of said openings having a length extending circumferentially around said outer cooling gallery, and said lengths of said anti-coking openings varying from one another.

11. The piston of claim 10, wherein each of said anti-coking openings has a circular or oblong shape.

12. The piston of claim 10, wherein each of said anti-coking openings has a perimeter, and said outer gallery floor extends continuously around the entire perimeter of each of said anti-coking openings.

13. A method of manufacturing a piston, comprising the steps of:

providing a piston body including a lower crown portion and an upper crown portion with an upper combustion wall, the upper crown portion and the lower crown portion forming an outer cooling gallery therebetween, the lower crown portion presenting an outer gallery floor of the outer cooling gallery, the outer gallery floor having an oil inlet allowing oil to flow into the outer cooling gallery and an oil outlet allowing oil to flow out of the outer oil gallery;

the step of providing the piston body including joining the upper crown portion to the lower crown portion;

disposing at least one insert in the outer cooling gallery, the at least one insert being sized to prevent the at least one insert from escaping through the oil inlet or the oil outlet;

the step of disposing the at least one insert in the outer cooling gallery being conducted after the joining step; and the step of disposing the at least one insert in the outer cooling gallery including compressing the least one insert through the oil inlet and/or the oil outlet, and then allowing the at least one insert to expand inside the outer cooling gallery.

14. The method of claim 13, wherein the outer cooling gallery presents an oil passage extending circumferentially around the upper crown portion, the at least one insert includes a helical coil, the helical coil presents a center coil opening extending circumferentially around the outer cooling gallery and aligned with the oil passage for allowing oil to flow therethrough.

15. The method of claim 13, wherein the inserts include balls formed of steel, coil springs, or chips formed of polymer with abrasive filler.

16. The method of claim 15, wherein the inserts include the chips formed of polymer with the abrasive filler, and the abrasive filler includes at least one of metal fibers and glass fibers.

17. The method of claim 13, wherein the at least one insert has a shape being round, polygonal, square, triangular, prismatic, and/or toroidal.

18. The method of claim 13, wherein the at least one insert includes at least one prismatic rod or prismatic wire having one axis significantly longer than two other axes.

19. The method of claim 13 wherein the step of providing the piston body includes welding the upper crown portion to the lower crown portion after disposing the at least one insert in the outer cooling gallery.

20. A method of manufacturing a piston, comprising the steps of:

providing a piston body including a lower crown portion and an upper crown portion with an upper combustion wall, the upper crown portion and the lower crown portion forming an outer cooling gallery therebetween, the lower crown portion presenting an outer gallery floor of the outer cooling gallery, the outer gallery floor including a plurality of anti-coking openings, and the anti-coking openings being disposed sequentially in decreasing spaced relation from one another.

21. A method of manufacturing a piston, comprising the steps of:

providing a piston body including a lower crown portion and an upper crown portion with an upper combustion wall, the upper crown portion and the lower crown portion forming an outer cooling gallery therebetween, the lower crown portion presenting an outer gallery floor of the outer cooling gallery, the outer gallery floor presenting a plurality of anti-coking openings extending therethrough, each of the openings having a length extending circumferentially around the outer cooling gallery, and the lengths of the anti-coking openings varying from one another.

* * * * *